US006749547B2

(12) United States Patent
Krull

(10) Patent No.: US 6,749,547 B2
(45) Date of Patent: Jun. 15, 2004

(54) WEIGHT SELECTION METHODS AND APPARATUS

(76) Inventor: Mark A. Krull, P.O. Box 57, Greencastle, IN (US) 46135

( * ) Notice: Subject to any disclaimer, the term of this patent is extended or adjusted under 35 U.S.C. 154(b) by 118 days.

(21) Appl. No.: 09/796,233

(22) Filed: Feb. 28, 2001

(65) Prior Publication Data

US 2002/0022559 A1 Feb. 21, 2002

Related U.S. Application Data

(63) Continuation-in-part of application No. 09/745,822, filed on Dec. 21, 2000, now Pat. No. 6,669,606.

(60) Provisional application No. 60/171,813, filed on Dec. 21, 1999.

(51) Int. Cl.[7] ..... A63B 21/072; A63B 21/06; A63B 21/08

(52) U.S. Cl. ..... 482/106; 482/93; 482/97; 482/108

(58) Field of Search ..... 482/106, 107, 482/108, 109, 93, 94, 98

(56) References Cited

U.S. PATENT DOCUMENTS

| | | | | | |
|---|---|---|---|---|---|
| 3,647,209 | A | * | 3/1972 | La Lanne | 482/103 |
| 5,839,997 | A | * | 11/1998 | Roth et al. | 482/107 |
| 6,261,022 | B1 | * | 7/2001 | Dalebout et al. | 482/107 |
| 6,422,979 | B1 | * | 7/2002 | Krull | 482/98 |

FOREIGN PATENT DOCUMENTS

| | | | | |
|---|---|---|---|---|
| SU | 1258447 | A | * 9/1986 | A63B/23/04 |

* cited by examiner

*Primary Examiner*—Nicholas D. Lucchesi
*Assistant Examiner*—Fenn C Mathew

(57) ABSTRACT

Discrete weight selecting members are movably mounted on a handle assembly and selectively rotatable into engagement with respective weight plates to provide adjustable resistance to exercise movement.

22 Claims, 14 Drawing Sheets

Fig. 20
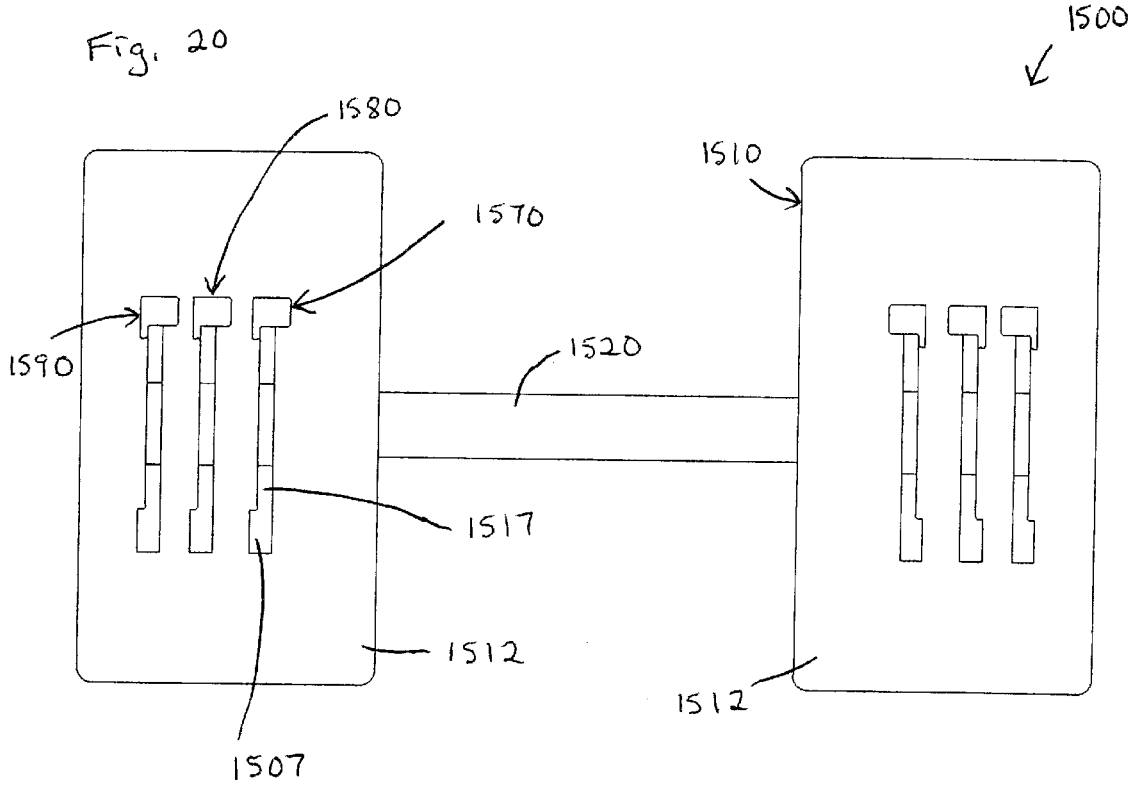
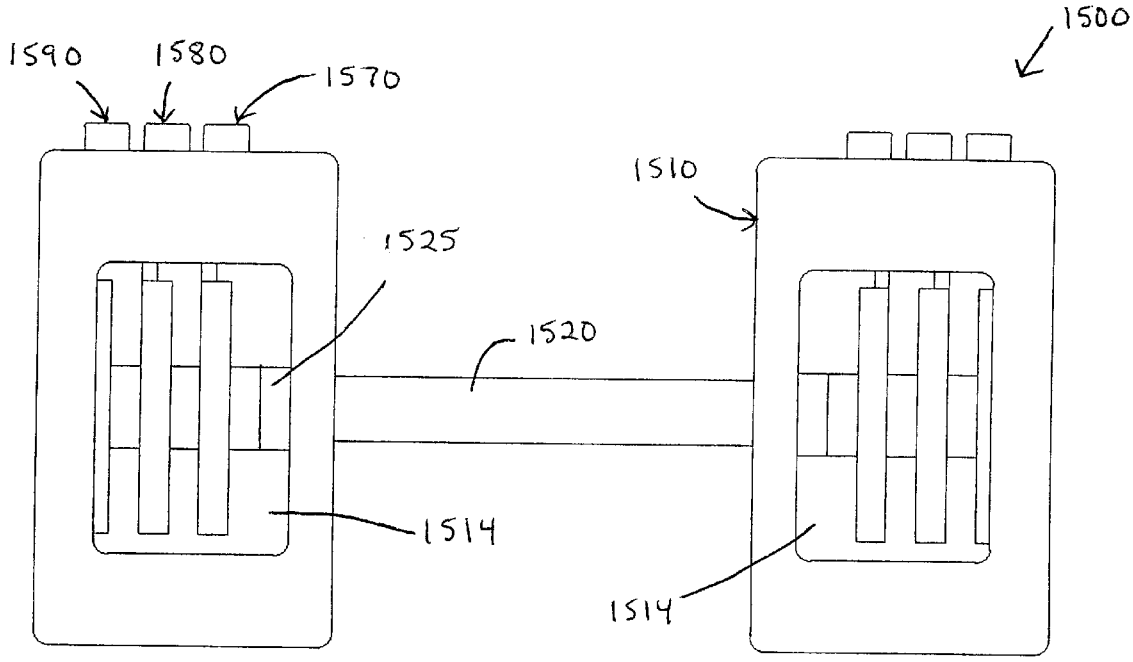
Fig. 21

Fig. 22
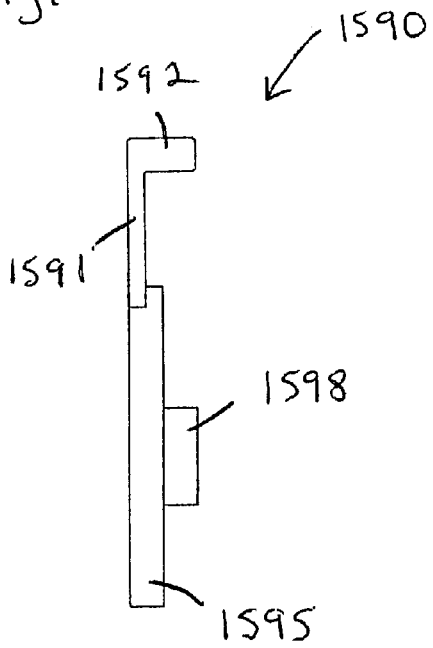
Fig. 23
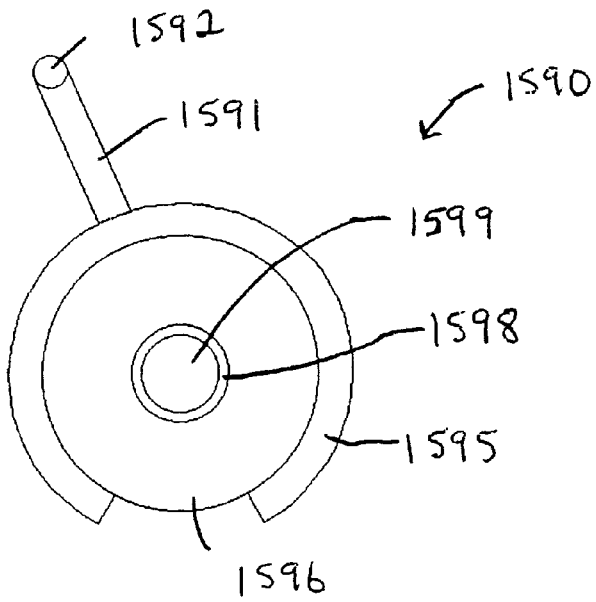
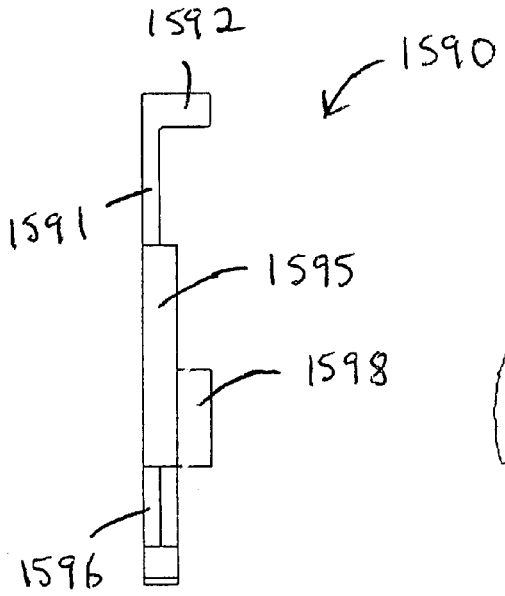
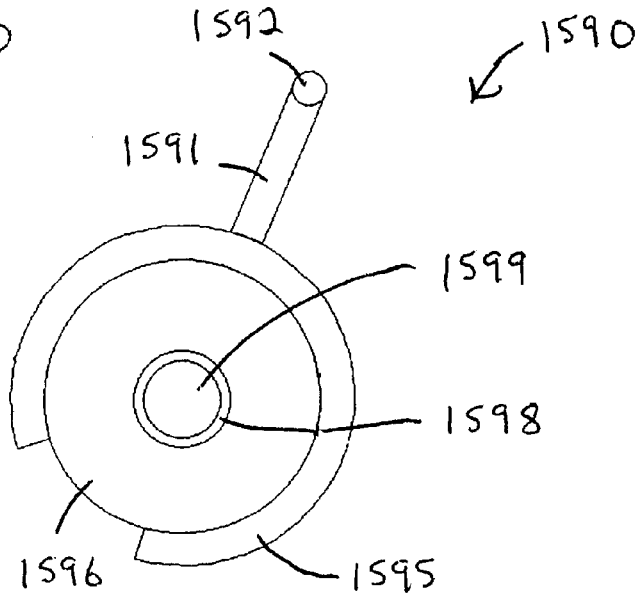
Fig. 24
Fig. 25

Fig. 31
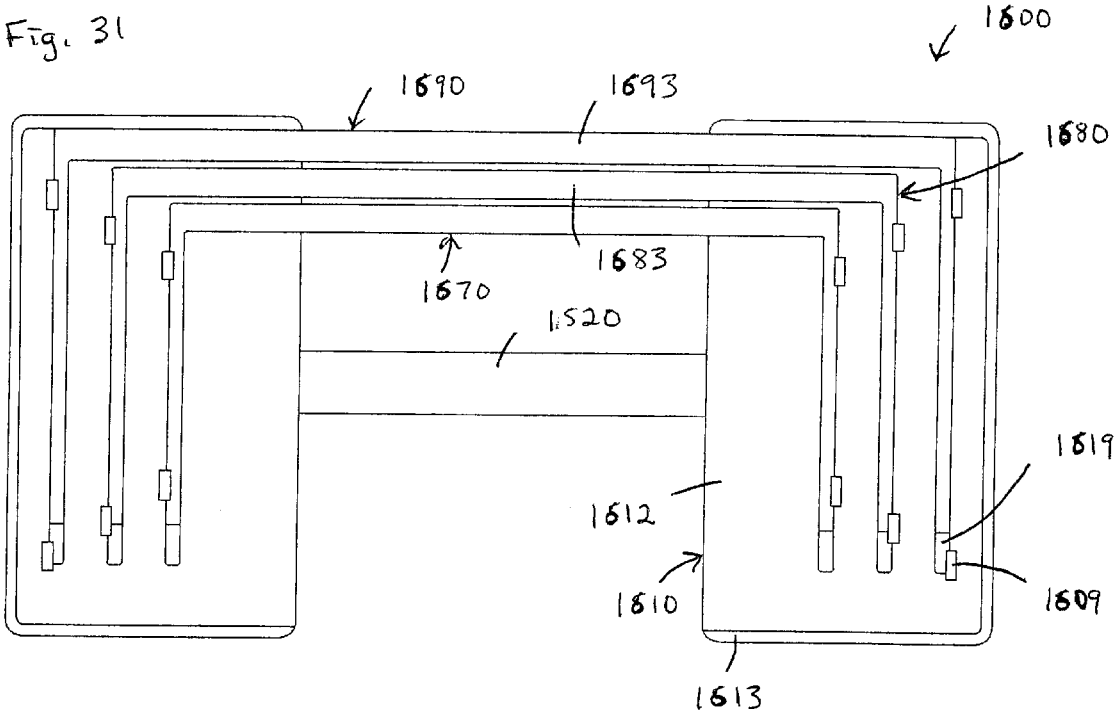
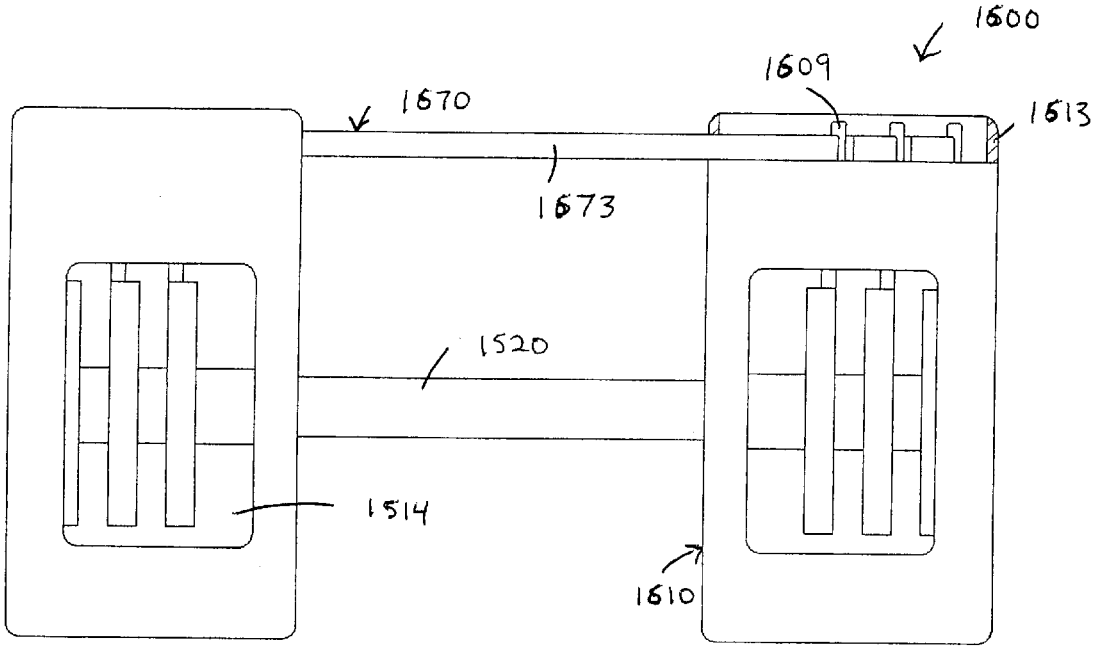
Fig. 32

WEIGHT SELECTION METHODS AND APPARATUS

CROSS-REFERENCE TO RELATED APPLICATIONS

This application is a continuation-in-part of U.S. patent application Ser. No. 09/745,822, filed on Dec. 21, 2000, now U.S. Pat. No. 6,669,606 which in turn, discloses subject matter entitled to the filing date of U.S. Provisional No. 60/171,813, filed on Dec. 21, 1999.

FIELD OF THE INVENTION

The present invention relates to exercise equipment and more particularly, to weight selection methods and apparatus suitable for use in connection with exercise dumbbells.

BACKGROUND OF THE INVENTION

Various weight selection methods and apparatus have been developed to provide adjustable resistance to exercise. In the case of free weights, for example, weight plates are typically mounted on opposite ends of a bar. In relatively advanced systems, the bar is stored in proximity to the weight plates, and a selection mechanism is provided to connect a desired amount of weight to the bar. Some examples of patented barbell/dumbbell improvements and/or features are disclosed in U.S. Pat. No. 4,284,463 to shields (discloses a dumbbell assembly having opposite side weights which are maintained in alignment on a base and selectively connected to a handle by means of cam driven pins on the weights); U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); U.S. Pat. No. 5,769,762 to Towley, III et al. (discloses a dumbbell assembly having a plurality of interconnected opposite side weights which are stored in nested relationship to one another and selectively connected to a handle by various means); and U.S. Pat. No. 5,839,997 to Roth et al. (discloses a dumbbell assembly having opposite side weights which are maintained in alignment on a base and selectively connected to a handle by means of eccentric cams on a rotating selector rod. Despite these advances and others in the field of weight selection, room for improvement remains.

SUMMARY OF THE INVENTION

One aspect of the present invention is to provide dedicated weight selecting members that are rotatable into engagement with respective weight plates to provide adjustable resistance to exercise. In a preferred application, each weight selecting member is rotatably mounted on a common bar and separately rotatable relative to the bar and its respective weight. The bar has a longitudinal axis and is selectively movable in a radial direction into and out of alignment with a weight plate holder. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 20 is a top view of another dumbbell constructed according to the principles of the present invention;

FIG. 21 is a side view of the dumbbell shown in FIG. 20;

FIG. 22 is a side view of a weight selector on the dumbbell shown in FIGS. 20–21;

FIG. 23 is an end view of the weight selector shown in FIG. 22;

FIG. 24 is a side view of the weight selector shown in FIG. 22, and now shown rotated to a weight selecting orientation;

FIG. 25 is an end view of the weight selector shown in FIG. 24;

FIG. 31 is a top view of a dumbbell similar to the dumbbell shown in FIGS. 20–21, with respective opposite side weight selectors connected to one another;

FIG. 32 is a side view of the dumbbell shown in FIG. 31;

DETAILED DESCRIPTION OF THE PREFERRED EMBODIMENT

The present invention provides methods and apparatus for selectively adjusting weight resistance to exercise motion. Generally speaking, individual weight selecting members are rotatable into and out of engagement with respective weight plates to select any desired number or combination of the weight plates.

Figure 2:
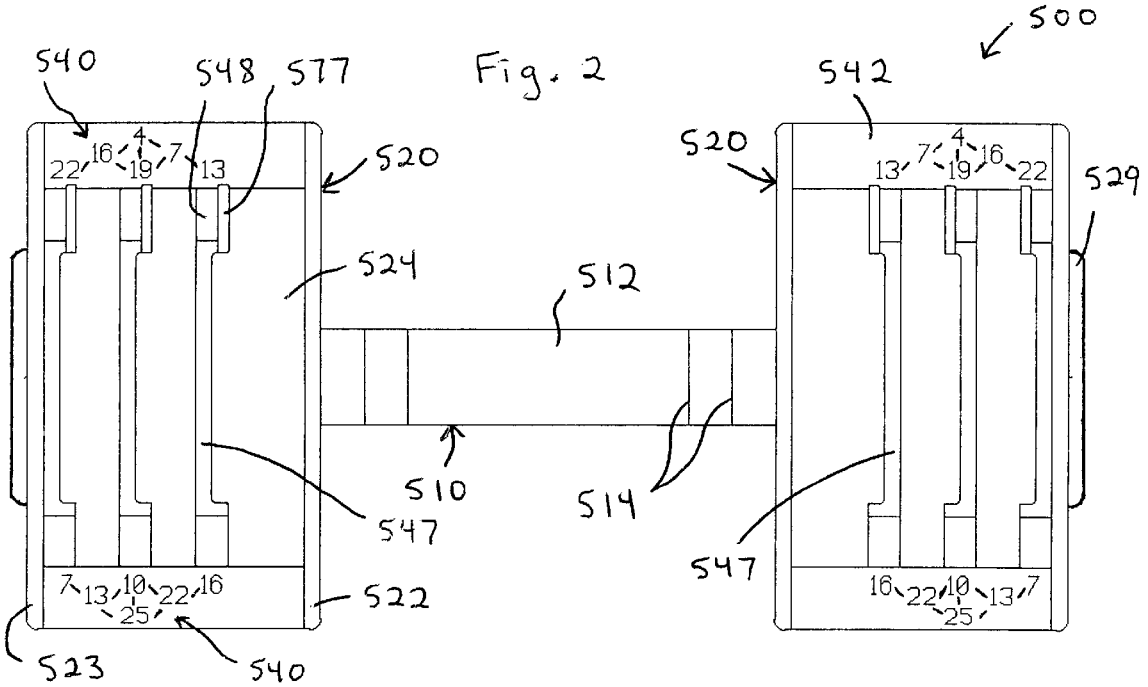
FIG. 2 is a top view of the dumbbell shown in FIG. 1.
Figure 1:
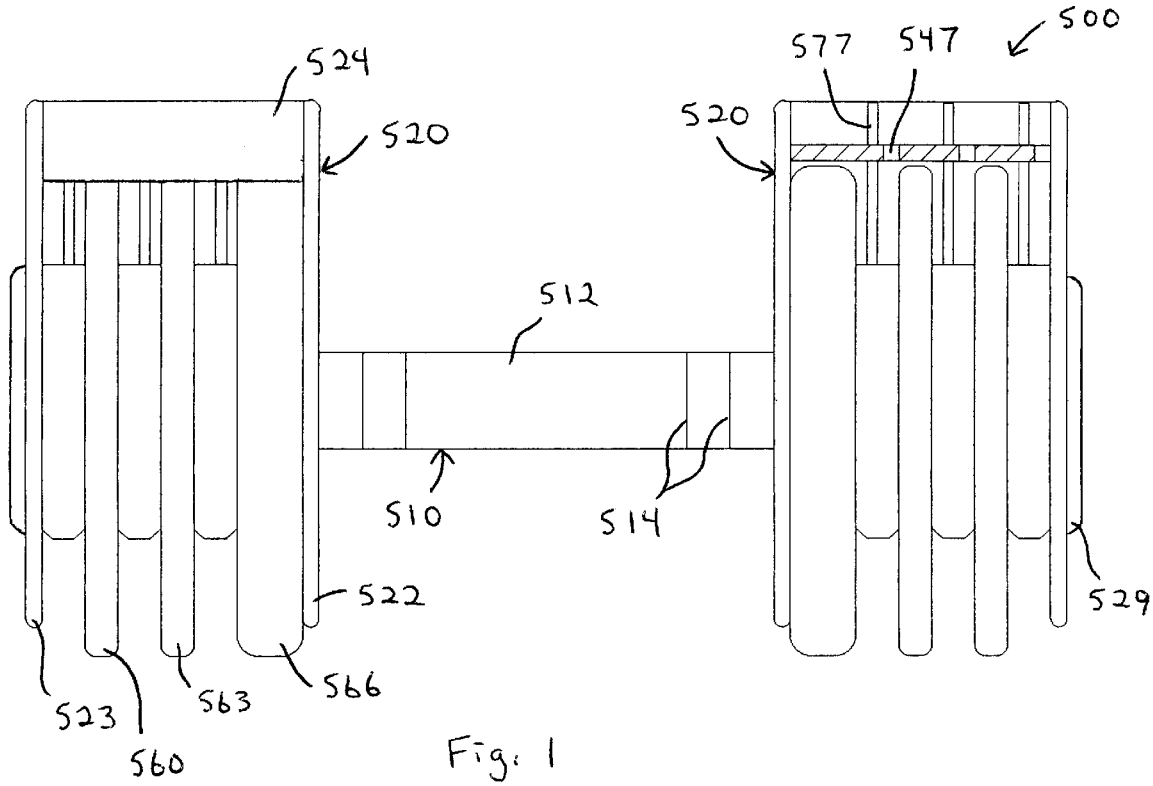
FIG. 1 is a partially sectioned side view of a dumbbell constructed according to the principles of the present invention.
Figure 11:
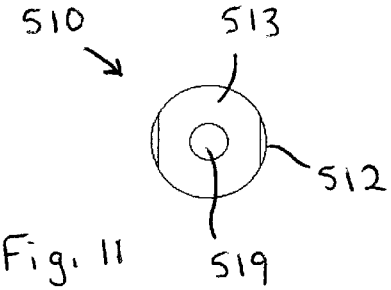
FIG. 11 is an end view of a shaft on the dumbbell shown in FIG. 1.

A first embodiment of the present invention is a dumbbell that is designated as 500 in FIGS. 1–2. The dumbbell 500 includes a bar 510 having a longitudinal axis. The bar 510 includes an intermediate portion or handle 512 that is sized and configured for grasping, and opposite end portions 513 that are secured to respective weight supports or housings 520. As shown in FIG. 11, the intermediate portion 512 of the bar 510 has a circular profile, and the end portions 513 of the bar 513 have "clipped" circular profiles (diametrically opposed, flat surfaces are cut into an otherwise circular profile. In other words, each end portion 513 of the bar 510 is bounded by two diametrically opposed, flat sides and two diametrically opposed, arcuate sides. The handle 512 may be knurled or coated for gripping purposes, and indicia, such as the rings designated as 514 in FIGS. 1–2, may be provided on the handle 512 to facilitate centering of a person's hand relative to the selected weight (as further discussed below). A threaded hole 519 extends into each distal end of the bar 510 for reasons discussed below.

Figure 4:
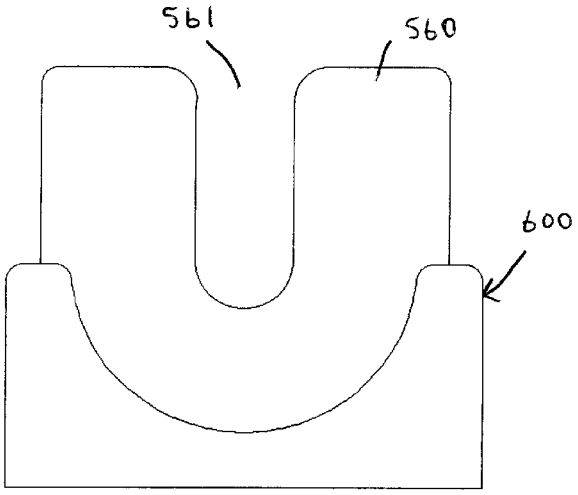
FIG. 4 is an end view of the cradle and weight plates shown in FIG. 3.
Figure 5:
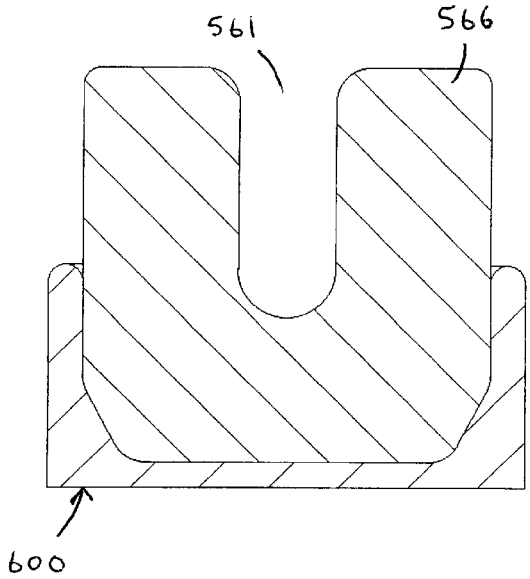
FIG. 5 is a sectioned end view of the cradle and weight plates shown in FIG. 3.

Each of the housings 520 includes an inside wall or end plate 522, an identical outside wall or end plate 523, and a top wall or top plate 524. Each housing 520 is sized and configured to accommodate a respective set of three weight plates 560, 563, and 566. When not in use, the weight plates 560, 563, and 566 rest on a cradle designated as 600 in FIGS. 3–5. The cradle 600 includes a base or bottom 601, and upwardly opening boxes 602 extending upward from opposite ends of the base 601. Generally U-shaped ridges 603 span respective boxes 602 and define dedicated, axially spaced slots for the weight plates 560, 563, and 566. The ridges 603 extend upward along opposite sides of each box 602 to maintain stability of the weight plates 560, 563, and 566, and dip downward in the middle to provide clearance for components on the housings 520. Other weight supporting arrangements are disclosed in U.S. Pat. No. 4,284,463 to Shields; U.S. Pat. No. 4,529,198 to Hettick, Jr.; U.S. Pat. No. 4,822,034 to Shields; U.S. Pat. No. 5,769,762 to Towley, III et al.; U.S. Pat. No. 5,839,997 to Roth et al.; U.S. Pat. No. 6,033,350 to Krull; and/or U.S. Pat. No. 6,099,442 to Krull, all of which are incorporated herein by reference.

On the dumbbell 500, each plate 560 weighs one and one-half pounds; each plate 563 weighs three pounds; and each plate 566 weighs six pounds. Each of the plates 560 and 563 is one-half as thick as each plate 566, and in all other respects the plates 560, 563, and 566 are similar in size and shape. The plates 560 are either made from a material one-half as dense as the plates 563, or an interior portion of each plate 560, equal to one-half of the total volume, is removed. Certain manufacturing efficiencies may be realized by providing weight plates along the foregoing lines, but the present invention is not limited to such an arrangement.

Figure 3:
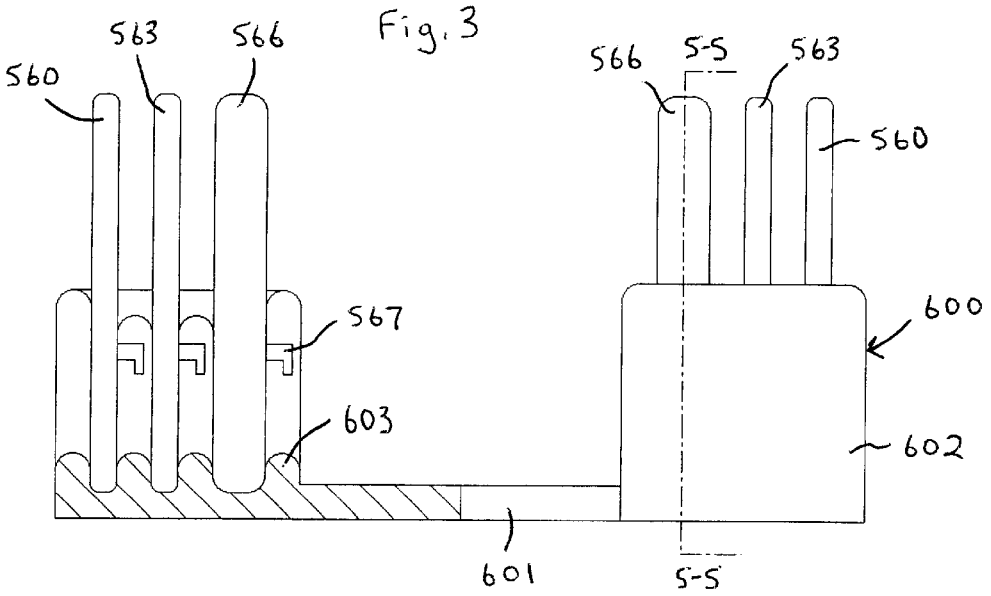
FIG. 3 is a partially sectioned side view of a cradle that is sized and configured to support the dumbbell shown FIG. 1 and/or weight plates used together with the dumbbell shown in FIG. 1.

Each weight plate 560, 563, and 566 may be described as a generally U-shaped plate having an upwardly opening slot 561. Recognizing that the slot 561 effectively lowers the center of mass for the plate, it may be desirable to make the slot extend downward past the center of the plate and/or to shape the plate with less mass at the bottom and/or more mass at the top, in order to provide a relatively balanced plate relative to the handle 512. Directly beneath the slot 561, a nub or shoulder 567, having an L-shaped profile, protrudes axially outward from the plate and then downward (as shown in FIG. 3).

Figure 13:
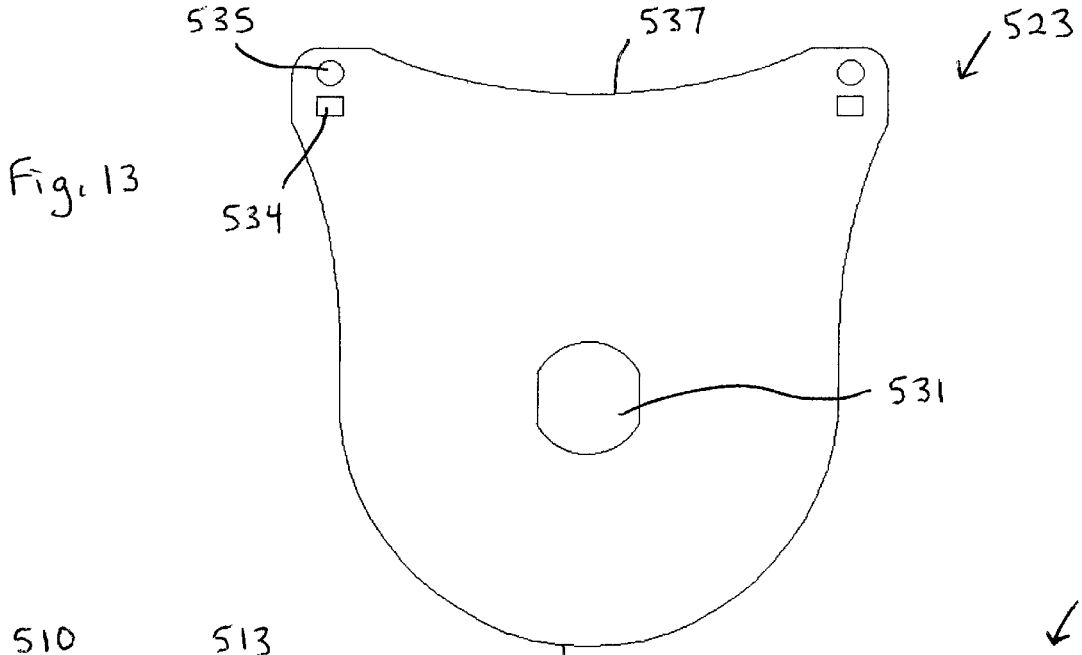
FIG. 13 is an end view of a housing end plate on the dumbbell shown in FIG. 1.

An end view of one of the end plates 523, which is representative of the other end plates 523 and 522, is shown in FIG. 13. An opening 531 extends through the end plate 523 to snugly receive a respective end portion 513 of the bar 510, and to resist passage of the intermediate portion 512 of the bar 510. The opening 531 and the end portion 513 of the bar are configured to prevent rotation of the end plate 523 relative to the bar 510. A lower edge 536 of the end plate 523 is contoured to complement and avoid interference with the cradle 600. An opposite, upper edge 537 of the end plate 523 is contoured to facilitate access to weight selecting members 570, as further discussed below. At opposite, upper corners of the plate 523, both a rectangular opening 534 and a circular hole 535 extend through the plate 523 to facilitate connections to a respective top plate 524, as further discussed below.

Figure 15:
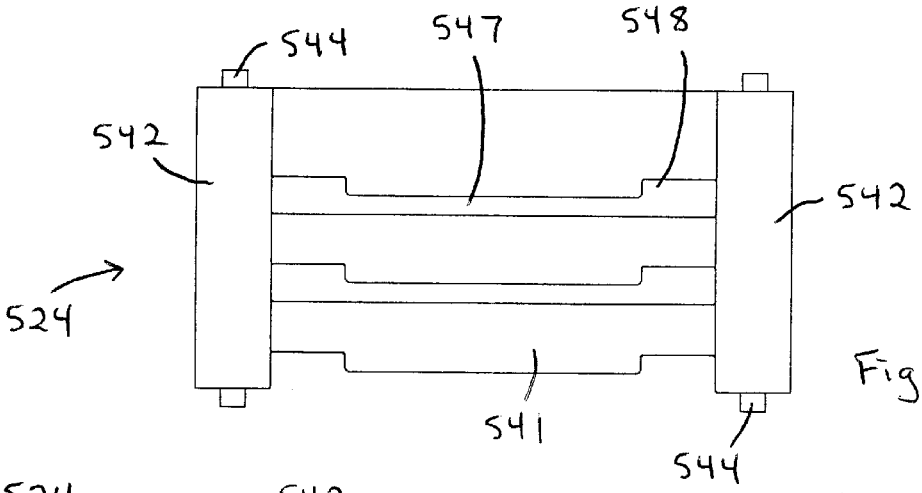
FIG. 15 is a top view of the housing top plate shown in FIG. 14.
Figure 14:
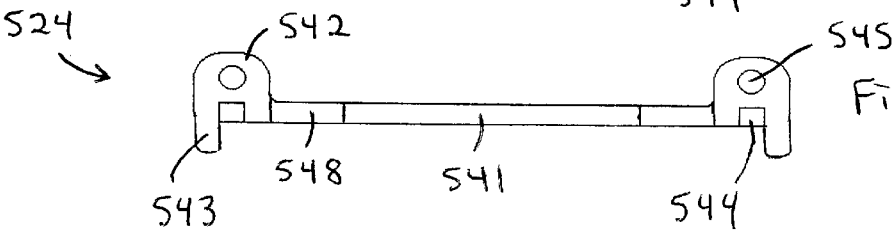
FIG. 14 is an end view of a housing top plate on the dumbbell shown in FIG. 1.

The top plate 524 is shown by itself in FIGS. 14–15. The top plate 524 may be described in terms of a sheet 541 that is divided into three strips by slots 547. At each end of each slot 547, a respective notch 548 is provided in the sheet 541 for reasons discussed below. Rails or beams 542 (as well as optional flanges 543) extend lengthwise along opposite sides of the strips or sheet 541. Tabs or posts 544 extend outward from opposite ends of each beam 542, and each tab 544 is sized and configured to fit inside a respective opening 534 in a respective end plate 522 or 523. Also, a circular hole 545 extends into each end of each beam 542, and aligns with a respective hole 535 in a respective end plate 522 or 523. Each hole 545 is sized and configured to receive and retain a screw or other suitable fastener. Among other things, both the beams 542 and the bar 510 help to maintain respective inner and outer end plates 522 and 523 in spaced, parallel alignment with one another. The beams 542 also help to prevent unintended movement of handles or levers 577 (which are described below in relatively greater detail).

Figure 6A:
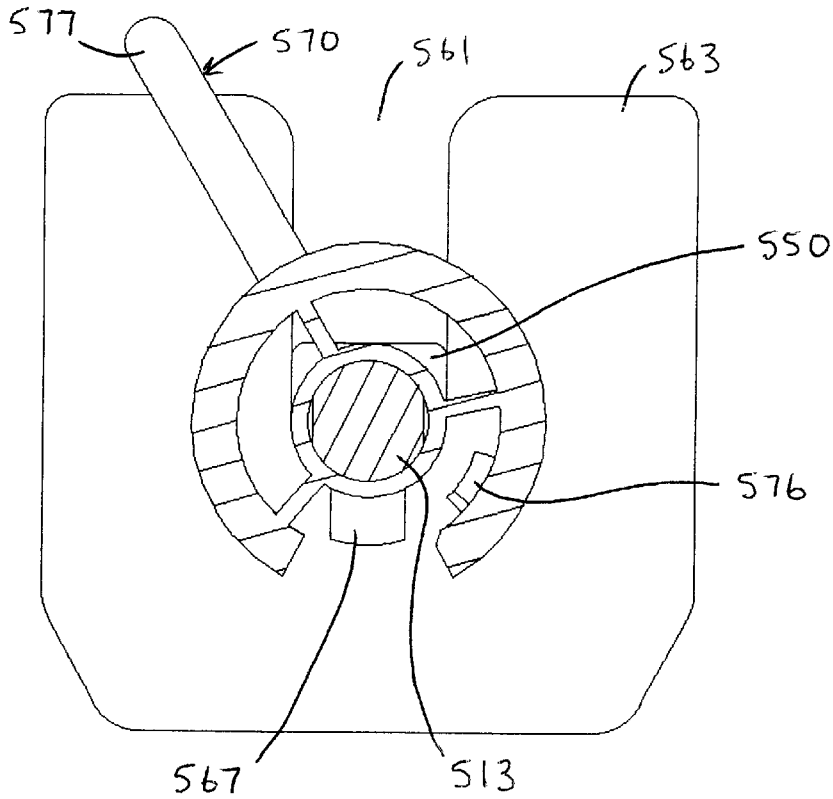
FIG. 6*a* is a partially sectioned end view of a weight selecting member on the dumbbell shown in FIG. 1, and shown in a disengaged position relative to its respective weight plate.
Figure 6B:
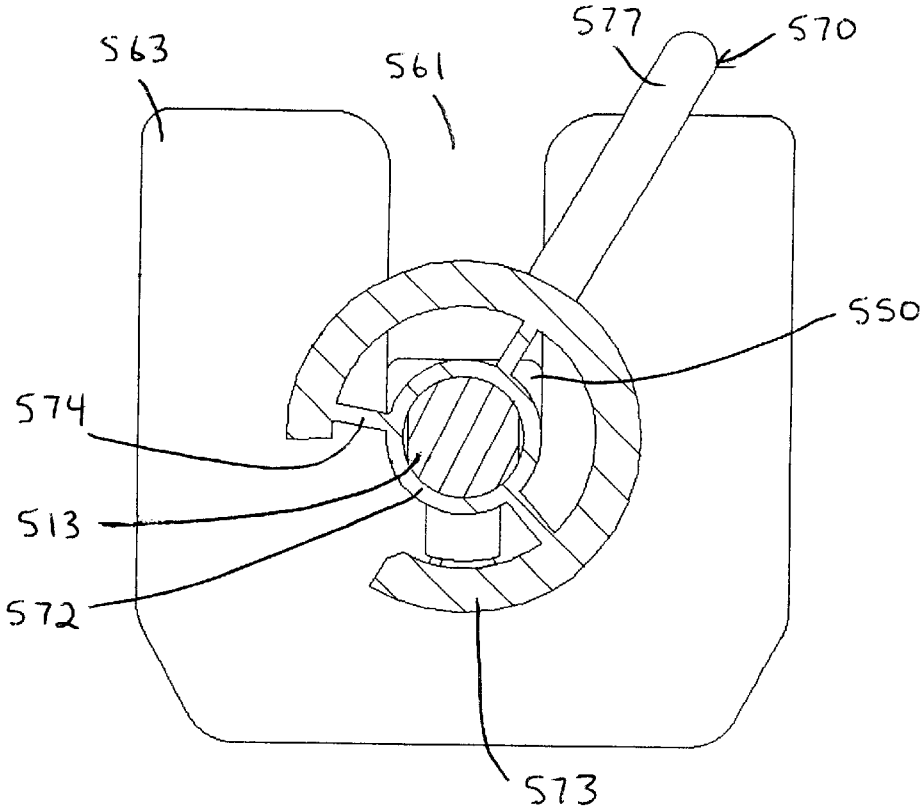
FIG. 6*b* is a partially sectioned end view of the weight selecting member shown in FIG. 6*a*, and now shown in an engaged position relative to its respective weight plate.
Figure 12:
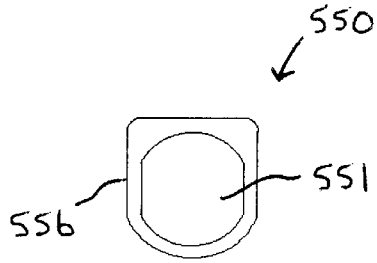
FIG. 12 is an end view of a spacer on the dumbbell shown in FIG. 1.

On each end portion 513 of the bar 510, an inner end plate 522 is fitted onto the bar 510, followed by a series of spacers 550 and weight selecting members 570 arranged in alternating fashion. One of the spacers 550 is shown by itself in FIG. 12 (and in relation to a weight plate 563 in FIGS. 6*a*–6*b*). Each spacer 550 is provided with a central opening 551 similar in size and shape to the opening 531 in each end plate 522 and 523. In other words, each spacer 550 is designed to fit onto a respective end portion 513 of the bar 510 and to resist rotation relative thereto. Each spacer 550 is bounded by one arcuate side and three flat sides, including opposing flat sides 556. As shown in FIGS. 6*a*–6*b*, the opposing sides 556 are sized to fit snugly inside the slot 561 in a respective weight plate 560, 563, and 566, and to prevent rotation of the weight plate relative thereto. The top plates 524 may also be configured to resist rotation of the weight plates 560, 563, and 566 relative to the bar 510.

For reasons of manufacturing efficiency, each of the spacers 550 may be made just long enough to span the width of one of the weight plates 563, in which case, two spacers 550 would be required to span the width of each of the largest weight plates 566. Under such circumstances, two spacers 550 are inserted onto each end portion 513 of the bar 510 after a respective inner end plate 522. A weight selecting member 570 is then inserted on each end portion 513 of the bar 510, followed by another spacer 550; another weight selecting member 570; another spacer 550; another weight selecting member; and finally, a respective outer end plate 523. A respective fastener 529 (with a large diameter head and/or an accompanying washer) is threaded into each hole 519 to secure the foregoing components of a respective housing 520 in place, and thereby define the handle assembly.

The spacers 550 and the weight selecting members 570 are configured and arranged so that the spacers 550 align with respective weight plates 560, 563, and 566, and the weight selecting members 570 align with respective ridges 603 on the cradle 600 (and are axially adjacent respective weight plates 560). In other words, the spacers 550 maintain the weight selecting members 570 in designated, axial positions along respective end portions 513 of the bar 510, and the weight selecting members 570 maintain the weight plates 560, 563, and 569 in designated, axial positions along respective end portions 513 of the bar 510.

Figure 10:
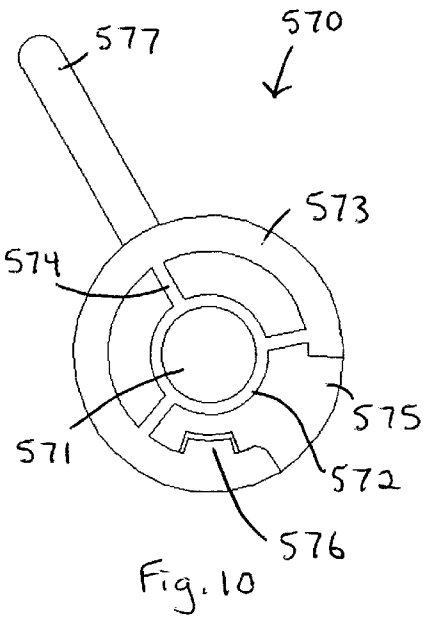
FIG. 10 is an opposite end view of the weight selecting member shown in FIG. 8.
Figure 9:
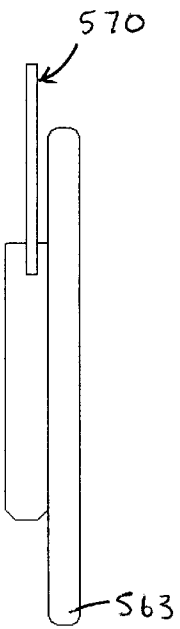
FIG. 9 is an opposite side view of the weight selecting member and weight plate shown in FIG. 7.
Figure 8:
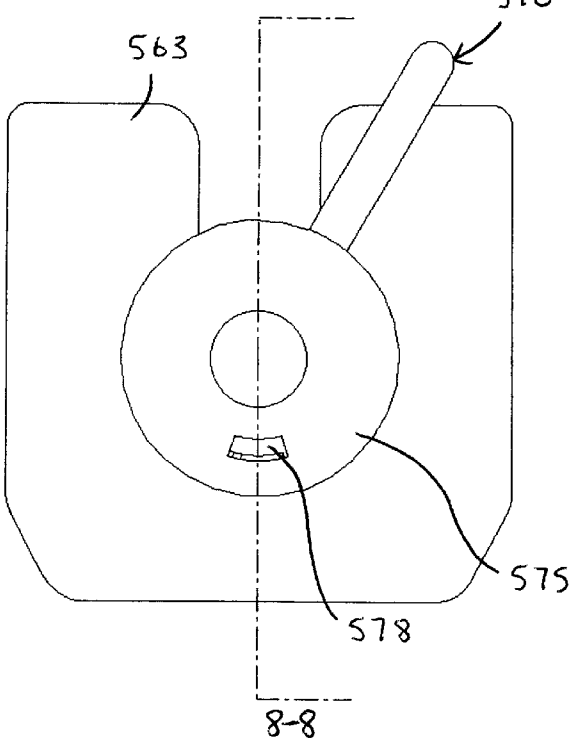
FIG. 8 is an end view of the weight plate and weight selecting member shown in FIG. 7.
Figure 7:
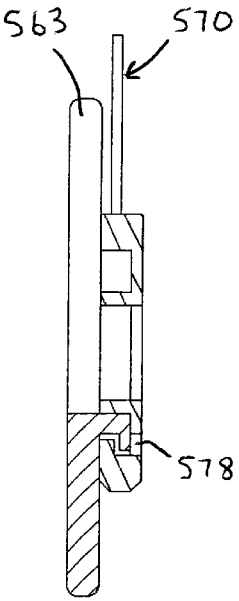
FIG. 7 is a partially sectioned side view of the weight selecting member and weight plate shown in FIGS. 6*a*–6*b;*

One of the weight selecting members 570 is shown by itself in FIG. 10, and is shown relative to a respective weight plate 563 in FIGS. 6*a*–6*b* and 7–9. The weight selecting member 570 is provided with a circular opening 571 that is sized and configured to receive a respective end portion 513 of the bar 510. As suggested by FIGS. 6*a*–6*b*, the opening 571 is also sized and configured to facilitate rotation of the weight selecting member 570 relative to the bar 510. A hub 572 is disposed about the opening 571, and connected to a rim 573 by means of both ribs or spokes 574 and an end cap or plate 575. A break or gap is provided in the rim 573, generally opposite a handle or lever 577 that is secured to the rim 573.

On the weight selecting member 570, a hook or catch 576 extends radially inward from the rim 573, on a side of the rim 573 opposite the end cap 575 and along a portion of the rim 573 proximate the gap. As shown in FIG. 6*a*, a "leading edge" of the catch 576 is beveled. Also, an opening or window, designated as 578 in FIGS. 7–8, extends through the end cap 575 to facilitate provision of the catch 576 during manufacture of the weight selecting member 570.

FIG. 6*a* shows a weight selecting member 570 in a disengaged position relative to its respective weight plate 563. In this disengaged position, the gap in the rim 573 is disposed directly beneath the shoulder 567 on the weight plate 563, and thus, there is nothing to prevent upward movement of the weight selecting member 570 and the bar 510 relative to the weight plate 563. FIG. 6*b* shows the same weight selecting member 570 in an engaged position relative to its respective weight plate 563. In this engaged position, which is the result of rotating the weight selecting member 570 clockwise sixty degrees relative to the weight plate 563 and the bar 510, the rim 573 is disposed directly beneath the shoulder 567 on the weight plate 563. As a result, the weight plate 563 is constrained to move upward together with the weight selecting member 570 and the bar 510. The catch 576 on the weight selecting member 570 moves between the shoulder 567 and the remainder of the weight plate 563 to discourage relative movement between the weight plate 563 and the weight selecting member 570.

Operation of the dumbbell 500 will now be described with reference to FIGS. 1–2. Each handle or lever 577 extends upward through a respective slot 547 in a respective top plate 524, and preferably occupies a position within a respective notch 548. Each handle 577 is configured as a leaf spring that is biased to remain in a respective notch 548 and/or to resist movement out of a respective notch 548. In other words, each handle 577 must be forced axially out of a notch 548 prior to circumferential movement about the bar 510 and along its respective slot 547. Also, each handle 577 tends to snap back into a respective notch 548 when pushed to either end of its slot 547. The ends of the slots 547 correspond with the positions of the handle 577 shown in FIGS. 6*a*–6*b*. Other biasing or latching arrangements may be used without departing from the scope of the present invention.

The handles 577 may be individually maneuvered to engage any combination of the weight plates 560, 563, and 566. In FIG. 2, each of the handles 577 is moved to the disengaged position (shown in FIG. 6*a*), and movement of the handle assembly away from the cradle 600 would leave all of the weight plates 560, 563, and 566 behind. The depicted dumbbell 500 is designed so that the "unloaded" handle assembly weighs 4 pounds. On the other hand, if all of the handles 577 are moved to the opposite ends of their respective slots 547, the fully loaded dumbbell 500 weighs 25 pounds. In FIG. 2, indicia 540 are provided on the top plates 524 to show how the handles 577 may be arranged to provide various levels of weight resistance. In this case, each line that extends from a weight figure toward a slot 547 indicates that the associated handle 577 should be moved toward that weight figure in order to set the dumbbell 500 to that weight. For example, the dumbbell 500 shown in FIG. 2 may be adjusted from 4 pounds to 7 pounds by moving the outermost handle 577 on each end of the dumbbell 500 to the opposite end of its respective slot 547.

Since the opposite side handles 577 are operable independent of each other, the dumbbell 500 may be adjusted to provide seven "half weight" amounts in addition to the weight amounts depicted on the top plates 524. For example, the dumbbell shown in FIG. 2 may be adjusted from 4 pounds to 5.5 pounds by moving only one of the outermost handles 577 to the opposite end of its respective slot 547. In other words, the present invention uses only three weight plates on each end of the dumbbell 500 to provide 15 levels of weight resistance (and without requiring the addition, removal, or shuffling of any components during the process). Recognizing that the "half-weight" amounts are not entirely balanced relative to the center of the handle 512, the rings 514 may be used as a visual reference for purposes of offsetting one's hand to compensate for the imbalance.

The weight selecting members 570 may also be configured to reduce rattling or wobbling of the selected weight plates. For example, leaf springs may be incorporated into the selectors 570 during formation thereof by injection molding. Such leaf springs would be configured and arranged to exert pressure against respective weight plates, which in turn, may be configured to be relatively thicker just beneath the nub 567, thereby enhancing the effect of the leaf spring. Another advantage of the weight selecting members 570 is the relative ease of manufacturing, especially as compared to the dumbbell disclosed in U.S. Pat. No. 5,839,997 to Roth et al. In this regard, the Roth dumbbell requires relatively more precise tolerances, thereby limiting manufacturing options and/or imposing additional manufacturing steps.

Figure 16A:
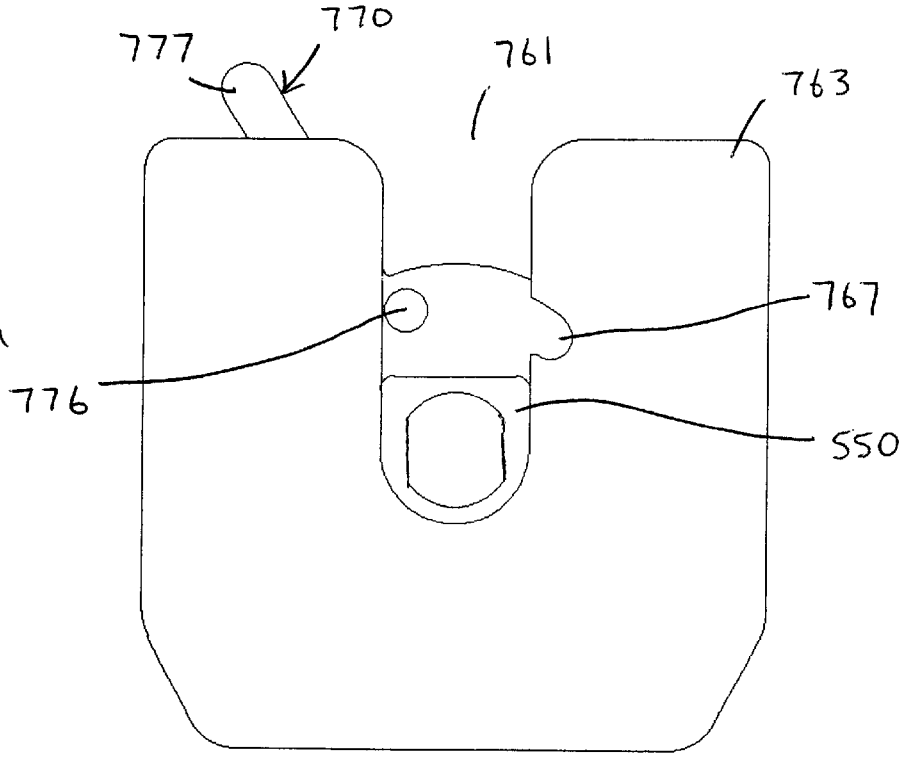
FIG. 16*a* is an end view of an alternative embodiment weight selecting member, shown in a disengaged position relative to its respective weight plate.
Figure 16B:
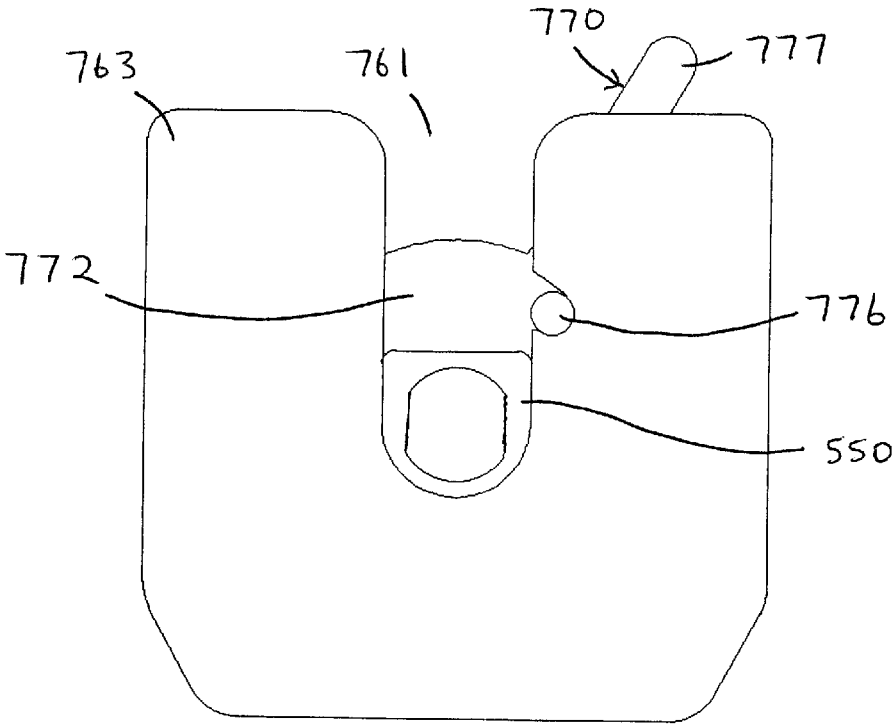
FIG. 16*b* is an end view of the weight selecting member shown in FIG. 16*a*, and now shown in an engaged position relative to its respective weight plate.

FIGS. 16*a*–16*b* show an alternative weight selecting arrangement suitable for use in accordance with the present invention. This alternative arrangement requires a different weight plate 763 and a different weight selecting member 770, but is otherwise similar in construction and operation to the dumbbell 500. FIGS. 16*a*–16*b* show a weight selecting member 770 relative to its respective weight plate 763 (and an associated spacer 550). The weight selecting member 770 includes a disc 772 (or other suitable member) provided with a circular opening 771 that is sized and configured to rotatably engage an end portion 513 of the bar 510. A peg 776 protrudes axially outward from the disc 772 and toward the respective weight plate 763. A radially extending handle 777 is connected to the disc 772 proximate the peg 776.

The weight selector 770 may be a unitary piece of resilient plastic that is formed by injection molding, or it may consist of multiple pieces that are assembled together. In the latter case, for example, it may be desirable to form a combined "hub and disc" part by injection molding in order to more precisely form and position holes for the bar 510 and the peg 776. A combined "disc and peg" part could then be made of cast metal to provide enhanced structural integrity. The disc portion of the metal part would fit onto the hub portion of the plastic part, and the peg portion of the metal part would insert through a hole in the plastic part. The handle or lever portion could be made of spring steel and sandwiched between the other two parts. Under such circumstances, it may be desirable to design the arrangement so that the peg 776 and the handle 777 are in direct radial alignment with one another. In any event, various known fastening methods could be used to hold the components together.

With reference back to FIGS. 16*a*–16*b*, the weight plate 763 is a generally U-shaped member having an upwardly opening slot 761 that is sized and configured to receive the spacer 550. A notch 767 extends into a sidewall of the slot 761, in a direction that may be described as circumferential relative to the longitudinal axis of the bar 510 (and the opening in the spacer 550). The notch 767 is sized and configured to receive the peg 776 on the weight selecting member 770. FIG. 16*a* shows the weight selecting member 770 in a disengaged position relative to the weight plate 763, and FIG. 16*b* shows the weight selecting member 770 in an engaged position relative to the weight plate 763. In other words, the peg 776 is rotatable into and out of the notch 767 for purposes of engaging and disengaging the weight plate 763.

Figure 17:
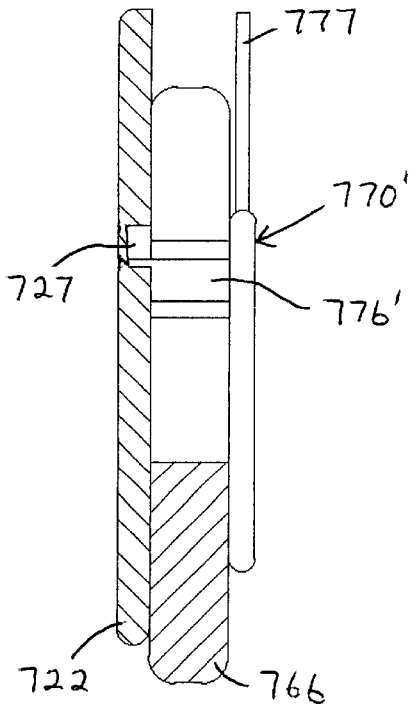
FIG. 17 is a partially sectioned side view of a reinforcing arrangement suitable for use in connection with the weight selection member of FIGS. 16*a*–16*b;*

FIG. 17 shows a reinforcing arrangement suitable for use in connection with the selector arrangement of FIGS. 16*a*–16*b*. The weight plate 766 is a thicker (and heavier) version of the weight plate 763. The weight plate 766 is disposed between a modified selector member 770' and an inner end plate 722 that is relatively thicker than those shown on the dumbbell 500. The weight selector member 770' has a relatively longer peg 776'. An arcuate groove 727 is formed in the plate 722 to receive and accommodate the distal end of the peg 776' along its arcuate path between disengaged and engaged positions relative to the weight plate 766.

Figure 18:
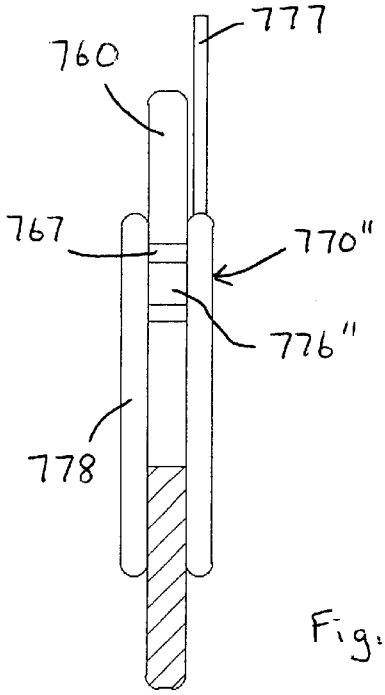
FIG. 18 is a partially sectioned side view of another reinforcing arrangement suitable for use in connection with the weight selection member of FIGS. 16*a*–16*b;*

FIG. 18 shows another reinforcing arrangement suitable for use in connection with the selector arrangement of FIGS. 16*a*–16*b*. The weight plate 760 is simply a lighter (but equally thick) version of the weight plate 763. The weight plate 760 is disposed between a modified selector member 770" and a mating disc 778. the mating disc 778 is rotatably mounted on an end portion 513 of the bar 510 in the same manner as the weight selecting member 770". The weight selecting member 770" has a relatively longer peg 776". An opening is provided in the mating disc 778 to receive and support the distal end of the peg 776". Among other things, this arrangement would allow the peg 776" to be made of steel and connected between the selector member 770" and the mating disc 778 (which may be made by injection molding). Furthermore, separate handles 777 could emanate from respective members 770" and 778 and be biased apart from one another for latching purposes.

Still another option is to form each weight selecting member 770" with an arcuate groove (similar to the groove 727 in the end plate 722, but relatively longer) to accommodate the relatively longer peg 776" of an adjacent weight selecting member 770". Such an arrangement would eliminate the mating discs 778 but perform a similar function.

Figure 19:
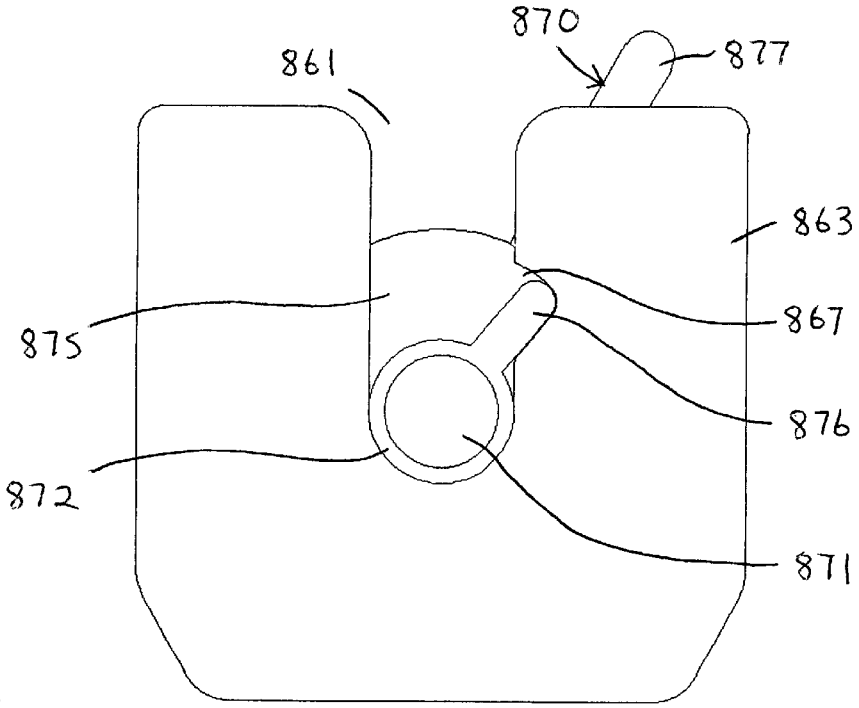
FIG. 19 is an end view of another alternative embodiment weight selecting member, shown in a disengaged position relative to its respective weight plate.
Figure 26:
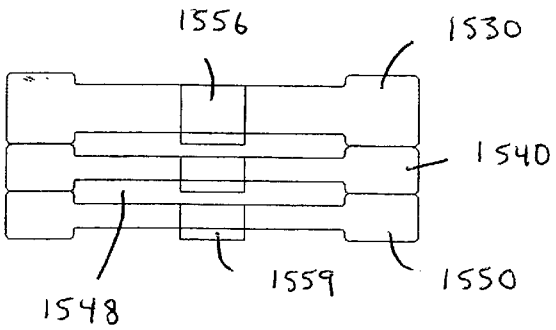
FIG. 26 is a top view of weights plates suitable for use with the dumbbell shown in FIGS. 20–21.
Figure 27:
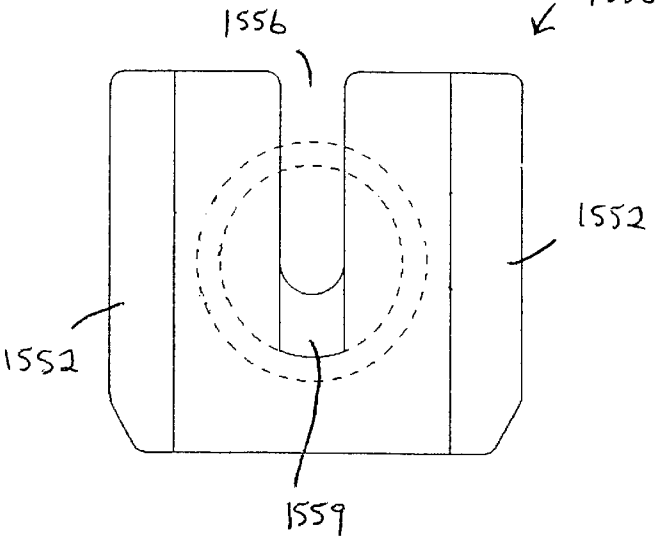
FIG. 27 is an end view of one of the weight plates shown in FIG. 26.
Figure 28:
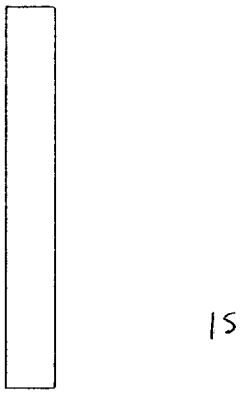
FIG. 28 is a side view of the weight plate shown in FIG. 27.
Figure 29:
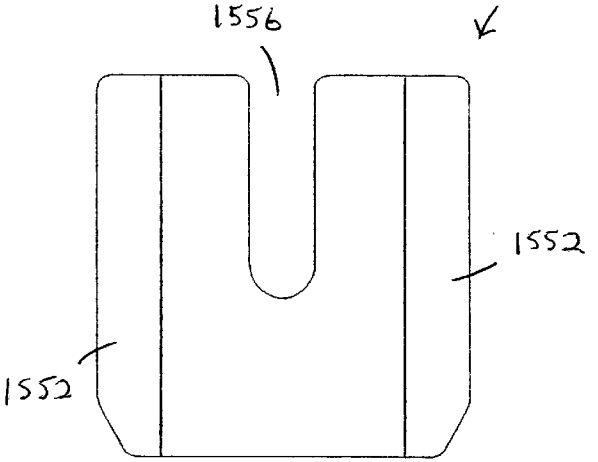
FIG. 29 is an opposite end view of the weight plate shown in FIG. 27.

FIG. 19 shows another alternative weight selecting arrangement suitable for use in accordance with the present invention. This alternative arrangement also requires a different weight plate 863 and a different weight selecting member 870, and it eliminates the spacers 550, as well. In all other respects it is similar in construction and operation to the dumbbell 500. The weight plate 863 is similar to the weight plate 763 (shown in FIGS. 16*a*–16*b*), except that the notch 867 has a wider mouth or entrance.

The weight selecting member 870 includes a cylindrical hub 872, as well as a disc-shaped plate 875. A circular opening 871 extends through both the hub 872 and the plate 875 to facilitate mounting and rotation of the selector 870 on an end portion 513 of the bar 510. The hub 872 extends into the axial space (inside the opening 861) that was occupied by the spacer 550 in FIGS. 16*a*–16*b*. However, the hub 872 is not configured to prevent rotation of the weight plate 863, so the top plates 524 (or some other housing component) must be configured to perform this function. A finger 876 projects radially outward from the hub 872 and terminates at a location corresponding to the location of the peg 776 on the selector 770 (shown in FIGS. 16*a*–16*b*). The axial thickness of the finger 876 is equal to that of the hub 872, and the finger 876 is sized and configured for rotation into and out of engagement with the notch 867. A handle 877 extends radially outward from the plate 875. Among other things, the arrangement could be reconfigured so that the handle 877 and the finger 876 extend parallel to one another, if so desired.

FIGS. 20–29 show another dumbbell that is constructed according to the principles of the present invention, and that combines aspects of the dumbbell 500 shown in FIGS. 1–2 and the weight selecting arrangement shown in FIG. 19. The dumbbell 1500 has weight selectors 1570, 1580, and 1590 which rotate relative to a handle 1520 and independent of one another to provide eight different, balanced weight combinations (and fifteen total combinations if balance is not a critical concern).

First and second weight supporting boxes 1512 are rigidly secured to respective end portions of the handle 1520 to collectively define a base or handle assembly 1510. The weight selectors 1570, 1580, and 1590 are disposed inside the boxes 1512 and are rotatably mounted on respective portions of the handle 1520. If economies of scale warrant making all of the weight selectors identical, spacers 1525 can be mounted on the handle 1520 to accommodate the additional thickness of the largest weight plates 1550. The boxes 1512 define weight receiving compartments 1514, and the weight selectors 1570, 1580, and 1590 divide the compartments 1514 into individual weight receiving slots.

FIGS. 22–23 show the weight selector 1590 in a disengaged orientation, and FIGS. 24–25 show the weight selector 1590 in a weight engaging orientation. The weight selector 1590 includes a cylindrical hub 1598 disposed about a circular hole 1599. A circular plate 1596 extends radially away from the hub 1598, and a cylindrical rim 1595 extends circumferentially about the majority of the plate 1596. A gap in the rim 1595 is disposed beneath the hub 1598 when the weight selector 1590 occupies the orientation shown in FIGS. 22–23. An arm 1591 extends radially away from the rim 1595 and terminates in an axially extending handle 1592.

FIGS. 26–29 show weight plates 1530, 1540, and 1550 suitable for use with the dumbbell 1500. Each plate 1530 weighs ten pounds; each plate 1540 weighs five pounds; and each plate 1550 weighs two and one-half pounds. The plates may be described as generally square plates having chamfered lower corners and relatively thick side walls 1552. The walls 1552 on adjacent plates cooperate to define central gaps (1548, for example) between the plates to accommodate respective, intervening weight selectors. An elongate slot 1556 extends downward from an upper edge of each plate to accommodate the hub 1598 of a respective weight selector. A boss 1559 projects outward from the plate immediately beneath the lower end of the slot 1556 for selectively engagement by the rim 1595 on a respective weight selector (see dashed lines). The weight plates are stored on a suitable cradle when not in use. In this instance, the cradle would have spacers extending upward from the bottom of the cradle and between the walls 1552 on the weights.

The arm 1591 on each of the weight selectors 1570, 1580, and 1590 extends through a respective slot (1517, for example) in the base 1510, thereby making each handle 1592 accessible to a user. The ends (1507, for example) of the slots are notched to discourage undesired rotation of the handles 1592. In particular, the handles 1592 must be forced toward the center of the dumbbell 1500 prior to pivoting relative to the handle 1520. The arms 1591 accommodate the deflection, in a manner similar to a leaf spring.

Figure 30:
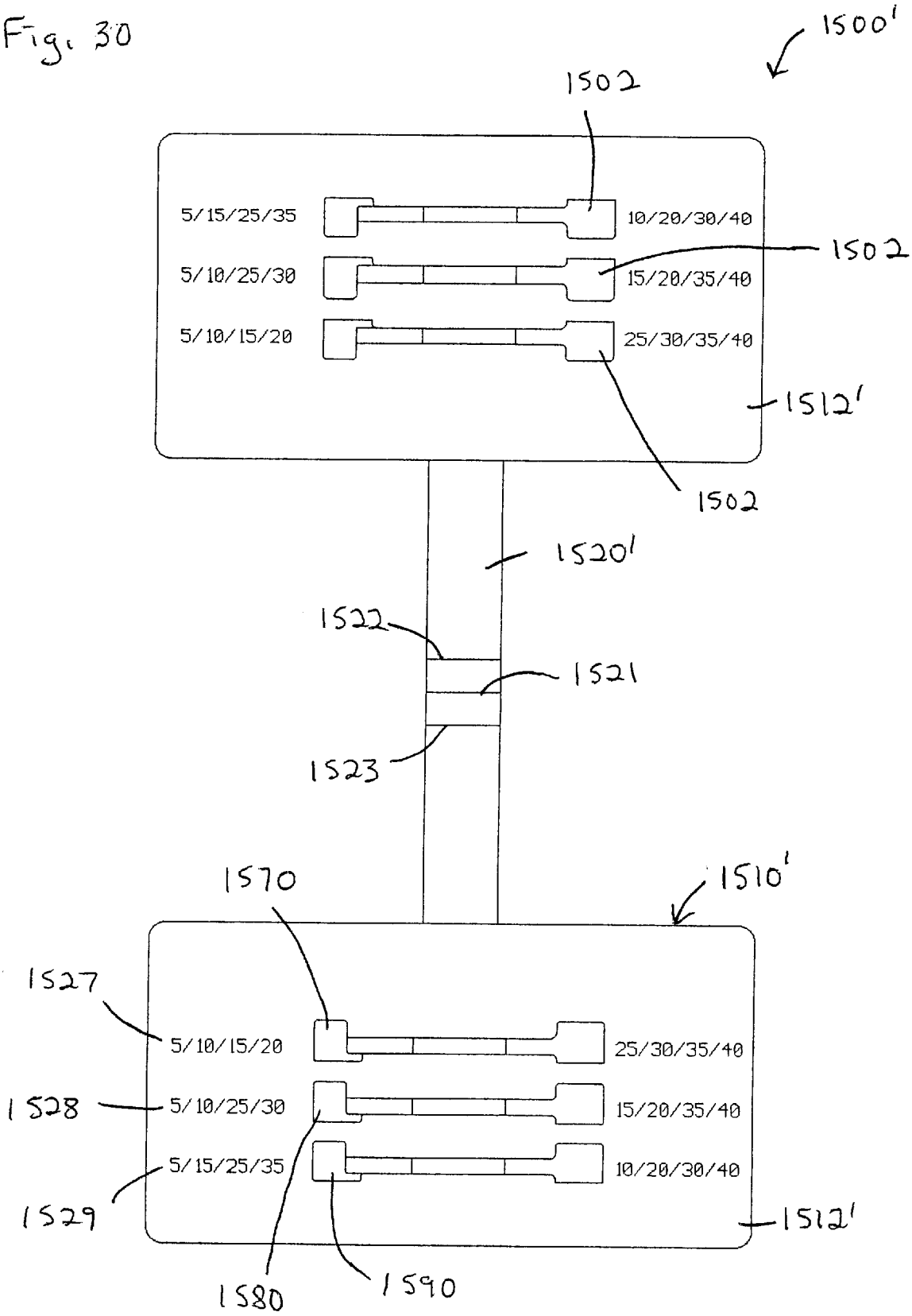
FIG. 30 is a top view of a dumbbell similar to the dumbbell shown in FIGS. 20–21, with optional features added.

As suggested by the common reference numerals, FIG. 30 shows a dumbbell 1500' similar to the dumbbell 1500, but with three additional features. First, indicia 1527, 1528, and 1529 on the tops of the boxes 1512' indicate the appropriate positions for the handles of respective weight selectors 1570, 1580, and 1590 for any desired amount of weight to be selected. For example, if twenty-five pounds is desired, then the handle 1592 on the weight selector 1590 is rotated toward the right side of FIG. 30, and the handles 1592 on the weight selectors 1580 and 1590 are rotated toward the left side of FIG. 30. Second, indicia 1521, 1522, and 1523 are provided on the handle 1520' to show appropriate center positions for the amount of weight that is selected. For example, if equal weight is selected on each end of the handle 1520', then a person should center his hand relative to the line 1521. On the other hand, if twenty-seven and one-half pounds is selected by rotating only the handle 1592 on the lower weight selector 1590 toward the right side of FIG. 30, then a person should center his hand relative to the line 1523.

The tops of the boxes 1512' on the dumbbell 1500' are provided with relatively larger openings 1502 at the ends of the slots nearer the right side of FIG. 30. The openings 1502 are sized and configured to admit passage of the handles 1592 during assembly of the dumbbell 1500', if so desired. Similar openings 1502 may be provided on the dumbbell 1500; or the weight selectors 1570, 1580, and 1590 may be assembled from more than one piece to facilitate insertion of the arms 1591 through the slots; or the handles 1592 may be made no larger than the openings 1507 shown in FIG. 20.

FIGS. 31–32 show a dumbbell 1600 similar to the dumbbell 1500, but with interconnected pairs of weight selectors designated as 1670, 1680, and 1690, and a base 1610 that has been modified to accommodate same. The base 1610 includes the same handle 1520 and similarly sized boxes 1612 rigidly secured to opposite ends of the handle 1520. As on the two previous embodiments, the boxes 1612 define weight receiving compartments 1514 which are separated into individual weight slots by weight selectors rotatably mounted on the handle 1520. The top of each box 1612 is provided with an upwardly extending rim 1613 that extends along the outside end and the opposing sides to shelter both the weight selectors and structure for latching same in place.

The weight selector 1670 may be described in terms of opposite side weight selectors 1570 having their handles 1592 interconnected by an integral extension 1673. The weight selector 1680 may be described in terms of opposite side weight selectors 1580 having relatively longer arms, and handles 1592 interconnected by a relatively longer integral extension 1683. The weight selector 1690 may be described in terms of opposite side weight selectors 1590 having even longer arms, and handles 1592 interconnected by an even longer integral extension 1693. Relatively longer slots (1619, for example) are provided in the tops of the boxes 1612 to accommodate pivoting of the longer arms. For assembly purposes, the arms may be inserted through respective slots and then interconnected by respective extensions 1673, 1683, and 1693. Inverted L-shaped tabs 1609 are provided on the boxes 1612 proximate the ends of the slots to latch respective weight selector pairs 1670, 1680, and 1690 in place. The tabs 1609 and/or the arms resiliently deflect to accommodate the latching and unlatching process. An advantage of this embodiment 1600 is that the opposite side weight plates are latched and unlatched simultaneously. A corresponding disadvantage is that the embodiment 1600 is not capable of providing the "half-weight" increments of adjustment.

FIGS. 33–36 show still another weight selecting arrangement 1000 suitable for use in accordance with the present invention. Generally speaking, this alternative arrangement 1000 incorporates aspects of the embodiments shown in FIGS. 16*a*–16*b* and 19, as well as some additional options that may be mixed and matched in various ways on various embodiments. The arrangement 1000 includes a spacer 550, a weight plate 1063, and a selector 1070. With the exception of a recessed area 1068, the weight plate 1063 is identical to the weight plate 863. As on certain other embodiments discussed above, the spacer 550 is sized and configured to resist rotation relative to the shaft 510, and to prevent rotation of the weight plate 1063 relative to the shaft 510.

Figure 35:
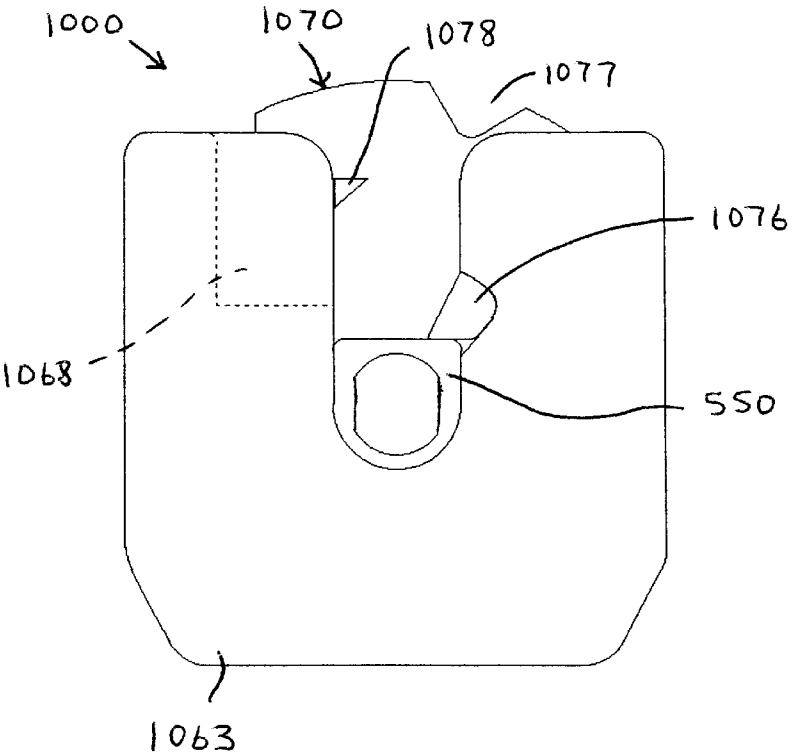
FIG. 35 is an end view of the weight selecting arrangement of FIG. 33, showing the weight selector in an engaged position relative to its respective weight plate.
Figure 34:
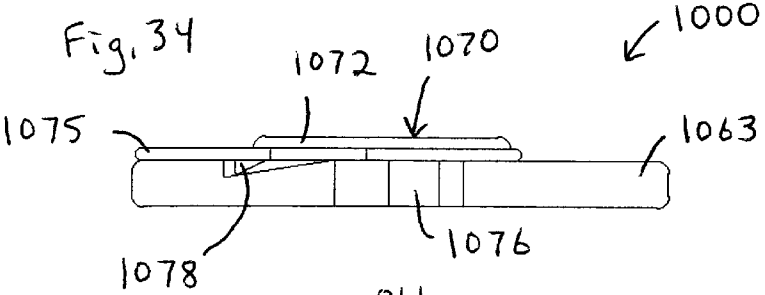
FIG. 34 is a top view of the weight selecting arrangement of FIG. 33.
Figure 33:
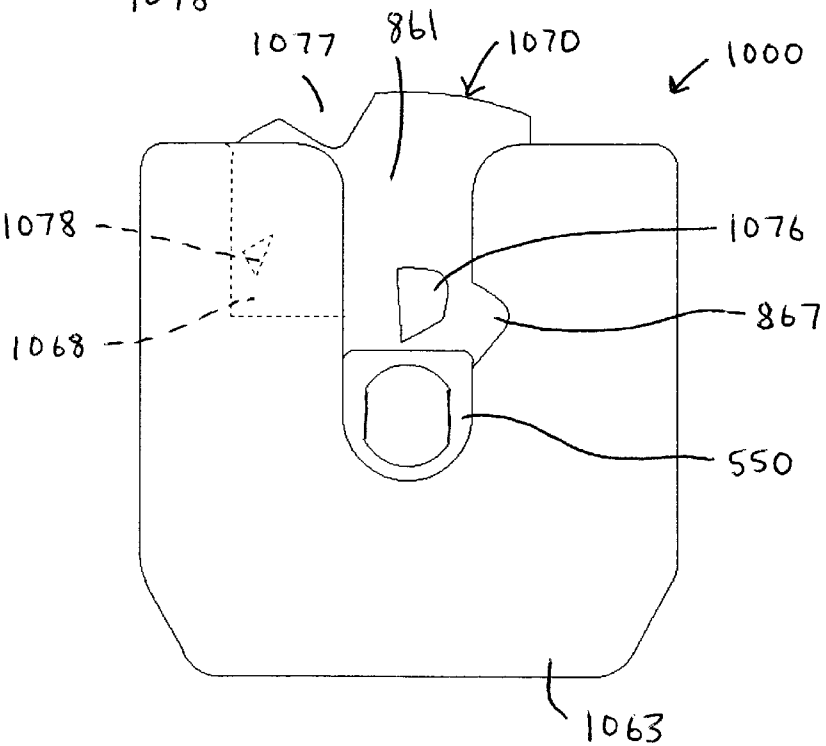
FIG. 33 is an end view of still another weight selecting arrangement constructed according to the principles of the present invention, showing a weight selector in a disengaged position relative to its respective weight plate.
Figure 40:
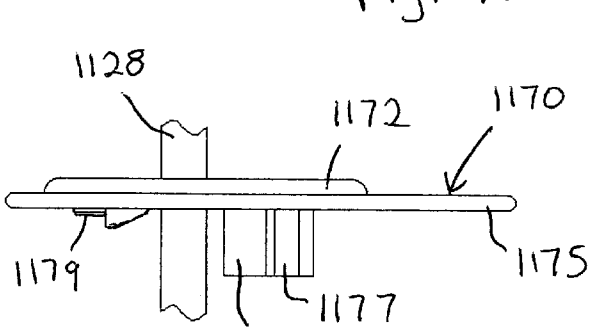
FIG. 40 is a top view of the weight selector of FIG. 39.

The weight selecting member 1070 includes a relatively small diameter disc 1072 having a relatively large axial thickness, and a relatively large diameter flange 1075 having a relatively small axial thickness. The flange 1075 is preferably integrally molded to an upwardly facing edge of the disc 1072. A circular opening extends through the center of the disc 1072 to rotatably engage an end portion 513 of the bar 510. A peg 1076 protrudes axially outward from the disc 1072 and toward the respective weight plate 1063. As shown in FIG. 35, the peg 1076 is sized and configured to fit snugly between the walls of the notch 867 and the top edge of the spacer 550. As a result of this arrangement, the spacer 550 effectively reinforces the peg 1076 against downward force of gravity acting upon the weight plate 1063. A notch 1077 is formed in the edge of the flange 1075 to facilitate manual rotation of the selector 1070 between the positions shown in FIGS. 33 and 35 (through a range of approximately thirty degrees).

Figure 36:
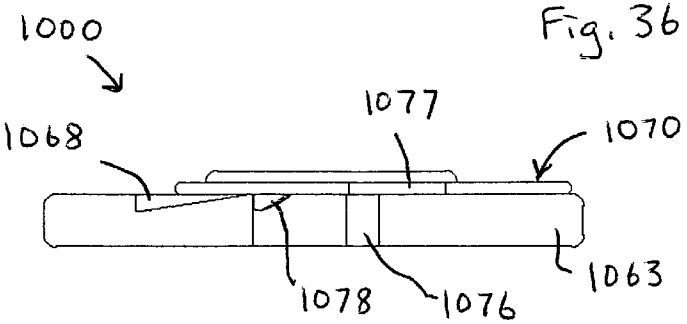
FIG. 36 is a top view of the weight selecting arrangement of FIG. 35.

A wedge 1078 on the flange 1075 protrudes toward the respective weight plate 1063 in the manner shown in FIGS. 33–36. The recessed area 1068 is provided in the weight plate 1063 to accommodate the wedge 1078 when the selector occupies the orientation shown in FIGS. 33–34. As the selector 1070 rotates toward the orientation shown in FIGS. 35–36, the wedge 1078 bears against a ramp or angled wall that defines the axially measured depth of the recessed area 1068, and the flange 1075 resiliently deflects away from the weight plate 1063. As the selector 1070 reaches the orientation shown in FIGS. 35–36, the wedge 1078 snaps into the slot 861 in the weight plate 1063. When arranged as shown in FIGS. 35–36, the wedge 1078 resists counterclockwise rotation of the selector 1070 relative to the weight plate 1063. To overcome this resistance, a user must push the flange 1075 axially away from the weight plate 1063 to provide clearance for the wedge 1078, and then, the selector 1070 may be rotated back to the orientation shown in FIGS. 33–34.

FIGS. 37–40 show still an alternative selector 1170 that is suitable for use on the foregoing embodiment 1000, and that has additional features that may be mixed and matched in various ways on various embodiments of the present invention. Like the selector 1070, the weight selecting member 1170 includes a relatively small diameter disc 1172 having a relatively large axial thickness, and a relatively large diameter flange 1175 having a relatively small axial thickness. A circular opening 1171 extends through the center of the disc 1172 to rotatably engage an end portion 513 of the bar 510. An identical peg 1076 protrudes axially outward from the disc 1172 and toward its respective weight plate 1063. Proximate the outer edge of the flange 1175, a rod 1177 protrudes axially outward from the flange 1175 and toward its respective weight plate, to facilitate manual rotation of the selector 1170 between the positions shown in FIGS. 37 and 39 (through a range of approximately thirty degrees).

Figure 39:
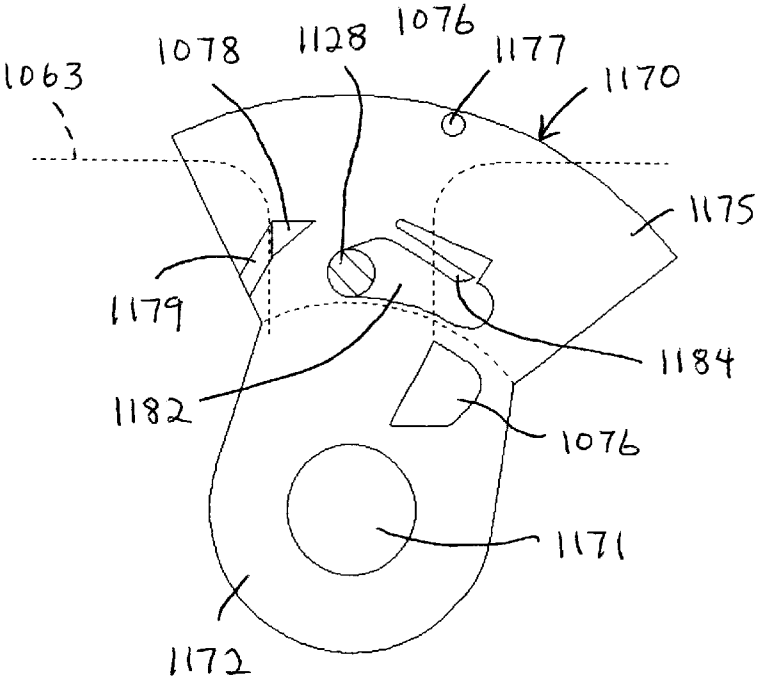
FIG. 39 is an end view of the weight selector of FIG. 37, showing the weight selector latched in an engaged position relative to its respective weight plate.
Figure 38:
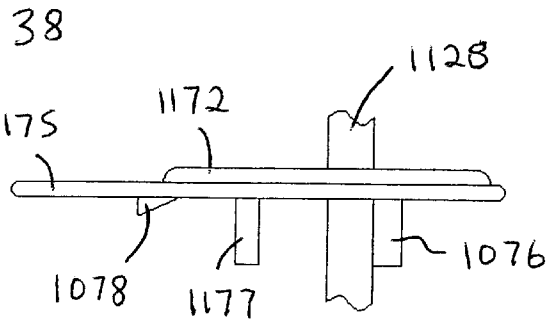
FIG. 38 is a top view of the weight selector of FIG. 37.
Figure 37:
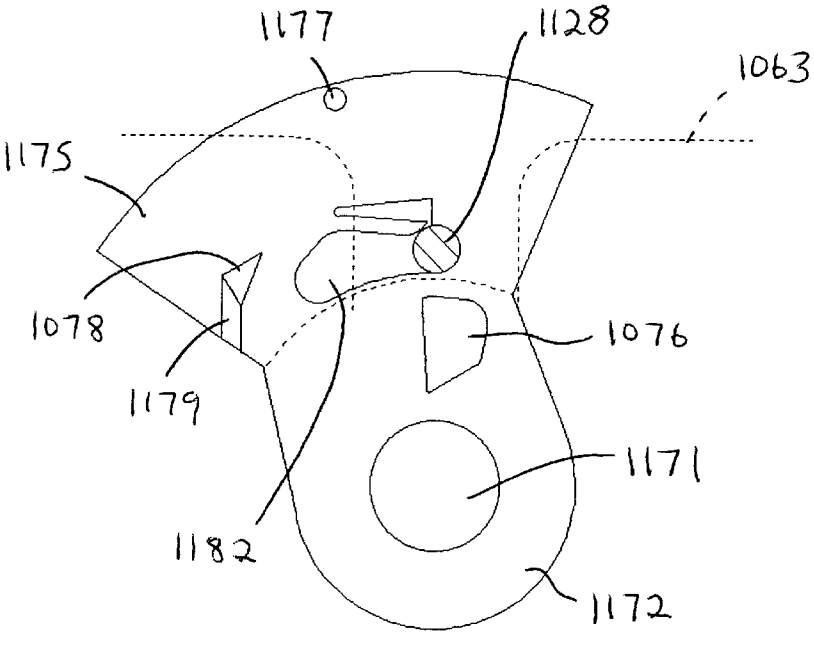
FIG. 37 is an end view of an alternative embodiment weight selector suitable for use as part of the weight selecting arrangement of FIG. 33, showing the weight selector latched in a disengaged position relative to a bar on the handle assembly.

An identical wedge 1078 is provided on the flange 1175 and performs the same function on this embodiment. A plateau 1179 also protrudes axially outward from the flange 1175, but to a lesser extent than the wedge 1078. The plateau 1079 adjoins the trailing edge of the wedge 1078 and is configured to fit within the same recessed area 1068 on the weight plate 1063. When the selector 1170 is moved to a latched, weight engaging position, as shown in FIG. 39, the plateau 1179 bears against the weight plate 1063 to reduce any axial "play" that might exist between the engaged weight plate 1063 and its selector 1170. Another suitable arrangement would be to provide an axially protruding leaf spring on the flange 1175, and to arrange the leaf spring occupy the slot 861 in the weight plate 1063 when oriented as shown in FIG. 37, and to bear against the weight plate 1063 when oriented as shown in FIG. 39.

A slot 1182 is provided in the selector 1170 to accommodate a bar 1128 regardless of the orientation of the selector 1170 relative to the shaft 510. The bar 1128 may be added to the handle assembly to provide additional, reinforcing support between inner and outer end plates 522 and 523 (operation of the levers 577 prevented such an arrangement). The bar 1128 may also be used to latch the selector 1170 in place relative to the handle assembly. In this regard, a resilient finger 1184 bounds the upper edge of the slot 1182 and protrudes into the space required for passage of the bar 1128. In other words, the finger 1184 encounters the bar 1128 and resiliently deflects during rotation of the selector 1170 between the orientations shown in FIGS. 37 and 39. A user must overcome the finger's resistance to flexing in order to rotate the selector 1170 between engaged and disengaged orientations.

The present invention may be described in various alternative ways. For example, the present invention may be described as an adjustable exercise weight system, comprising: a base which includes a handle and weight supports at opposite ends of the handle; weights sized and configured for engagement by the weight supports; and weight selectors rotatably mounted on the handle and disposed adjacent respective weights, wherein each of the weight selectors is independently rotatable between a weight engaging orientation and a disengaged orientation relative to its respective weight. The weights may be provided in opposite side pairs, and/or the opposite side weight selectors associated with each of the pairs may be interconnected to move as a unit. In addition and/or the alternative, indicia may be provided to show how the weight selectors should be maneuvered to select a desired amount of weight, and/or to indicate where the handle should be grasped in order to offset an imbalance in the amount of selected weight at each end of the handle. Moreover, many different structures may be used to latch the selectors in desired orientations relative to the handle assembly and/or the selected weights.

The present invention may also be described in terms of various methods of providing adjustable weight resistance. For example, one such method involves the provision of a plurality of aligned weights; the provision of a bar having discrete, rotatable weight selectors for respective weights; and the rotation of the selectors relative to the weights until a respective weight selector underlies each desired weight. This method may further involve providing a visual indication of the amount of weight that is currently selected; latching the weight selectors in desired positions; and/or exerting axial pressure against the selected weights. With regard to this last option, a weight stabilizing system may be implemented by providing protruding portion(s) on the weight plates and/or the weight selectors, and arranging the protruding portions to engage only when the weight selectors are rotated into engagement with respective weights. For example, a leaf spring on the weight selector may be arranged to occupy the slot in the weight when not engaged, and to rest between spaced apart bumps on the weight when the weight selector is moved to an engagement orientation.

The foregoing description and accompanying figures disclose only some of the many conceivable embodiments to be constructed in accordance with the principles of the present invention. Other embodiments, methods, and/or variations will become apparent to those skilled in the art as a result of this disclosure. Moreover, those skilled in the art will recognize that aspects and/or one or more features of various methods and embodiments may be mixed and matched in numerous ways to arrive at still more variations of the present invention. In view of the foregoing, the scope of the present invention is to be limited only to the extent of the following claims.

What is claimed is:

1. An exercise apparatus, comprising:

a bar having a longitudinal axis;

weight selectors rotatably mounted on opposite ends of said bar at discrete axial locations, wherein each of said selectors includes a weight engaging portion;

a base; and a plurality of weights maintained in alignment on said base, wherein said weights are provided with slots sized and configured to accommodate insertion and removal of said bar, and said weights cooperate to define gaps to accommodate insertion and removal of respective selectors in axial alignment with said weights, and each of said weights is configured for engagement by a respective weight engaging portion when a respective weight selector occupies a first orientation relative to said bar, and for disengagement by a respective weight engaging portion when a respective weight selector occupies a second orientation relative to said bar; and biasing means, including a leaf spring on each of said weight selectors, for biasing said weight selectors to remain in desired orientations relative to said bar.

2. The apparatus of claim 1, wherein at least one said weight engaging portion is an axially extending lip that is selectively rotatable beneath an axially extending nub on a respective one of said weights.

3. The apparatus of claim 1, wherein at least one said weight engaging portion is an axially extending peg that is selectively rotatable into a transversely opening notch in a respective one of said weights.

4. The apparatus of claim 1, further comprising first and second covers mounted on respective said ends of said bar to overlie respective said weights, wherein each said leaf spring protrudes through a respective slot in a respective one of said covers.

5. The apparatus of claim 4, wherein each said leaf spring occupies a first notch associated with a respective said slot when a respective one of said weight selectors occupies the first orientation, and each said leaf spring occupies a second notch associated with a respective said slot when a respective one of said weight selectors occupies the second orientation.

6. The apparatus of claim 4, wherein indicia is provided on said covers to indicate how much force is required to lift said bar and any said weights are connected thereto.

7. The apparatus of claim 1, further comprising first and second covers mounted on respective said ends of said bar to overlie respective said weights.

8. The apparatus of claim 1, wherein an intermediate portion of said bar is axially aligned with the opposite ends, and is sized and configured for grasping.

9. An exercise apparatus, comprising:

a bar having a longitudinal axis;

weight selectors rotatably mounted on opposite ends of said bar at discrete axial locations, wherein each of said selectors includes a weight engaging portion;

a base; and a plurality of weights maintained in alignment on said base, wherein said weights are provided with slots sized and configured to accommodate insertion and removal of said bar, and said weights cooperate to define gaps to accommodate insertion and removal of respective selectors in axial alignment with said weights, and each of said weights is configured for engagement by a respective weight engaging portion when a respective weight selector occupies a first orientation relative to said bar, and for disengagement by a respective weight engaging portion when a respective weight selector occupies a second orientation relative to said bar; and spacers mounted on said bar between respective said weight selectors and at axially spaced positions that align with respective said weights, wherein said spacers are sized and configured for insertion into respective said slots.

10. The apparatus of claim 9, wherein said spacers are configured and arranged to resist rotation relative to said bar.

11. The apparatus of claim 9, wherein said spacers are configured and arranged to prevent rotation of respective weights relative to said bar.

12. An exercise apparatus, comprising:

a bar that defines a longitudinal axis;

discrete weight engagement members rotatably mounted on opposite ends of said bar at discrete axial locations for rotation about the bar, wherein said members include respective radially extending portions and respective axially extending portions;

a base; and a plurality of weights maintained in alignment on said base, wherein said weights define respective slots to accommodate insertion of said bar, and gaps between adjacent said weights to accommodate insertion of respective said radially extending portions, and said axially extending portions are independently rotatable about the bar between respective weight engaging positions beneath respective said weights and respective disengaged positions out from under respective said weights.

13. The apparatus of claim 12, wherein an intermediate portion of said bar is axially aligned with the opposite ends, and is sized and configured for grasping.

14. An exercise apparatus, comprising:

a first set of weights;

a second set of weights;

a base sized and configured to support each said set of weights at a respective end of said bass;

a handle member having an intermediate portion that is sized and configured for grasping, a first end portion that is sized and configured to support said first set of weights, and an opposite, second end portion that is sized and configured to support said second set of weights; and weight selectors rotatably mounted on each said end portion, wherein each of said weight selectors is configured and arranged to selectively engage and disengage a respective one of said weights as a function of orientation relative to said handle member, wherein each of said weight selectors is independently rotatable between a weight engaging orientation and a weight disengaging orientation.

15. The apparatus of claim 14, further comprising a latching means for latching each of said weight selectors in either said orientation.

16. The apparatus of claim 15, wherein the latching means includes involves leaf springs on respective said weight selectors, wherein said leaf springs are movable into respective notches defined at a respective end of said handle member.

17. The apparatus of claim 16, wherein each end portion is configured as a weight housing having a top cover, and said leaf springs are configured and arranged to extend through respective slots in the top cover, and said notches are formed in the top cover at respective ends of respective said slots, and the leaf springs are biased to remain in respective said slots.

18. An exercise apparatus, comprising:

a first set of weights;

a second set of weights;

a base sized and configured to support each said set of weights at a respective end of said base;

a handle member having an intermediate portion that is sized and configured for grasping, a first weight housing disposed at a first end of said handle member and sized and configured to support said first set of weights, and a second weight housing disposed at an opposite, second end of said handle member and sized and configured to support said second set of weights; and weight selectors associated with each said weight housing, wherein said weight selectors include first portions that protrude through respective slots in a respective weight housing, and terminate in respective distal ends that are sized and configured for manual engagement by a person, and second portions that are selectively movable into engagement and disengagement relative to respective said weights.

19. The apparatus of claim 18, wherein at least one of said weight selectors has a lip that is selectively movable into and out of a position beneath a nub on a respective one of said weights.

20. The apparatus of claim 18, wherein at least one of said weight selectors has a peg that is selectively movable into and out of a position inside a notch in a respective one of said weights.

21. The apparatus of claim 12, wherein at least one of said weight engaging portions has an axially extending lip that is selectively rotatable about the bar into and out of a position beneath an axially extending nub on a respective one of said weights.

22. The apparatus of claim 12, wherein at least one of said weight engaging portions is an axially extending peg that is selectively rotatable about the bar into and out of a position inside a transversely opening notch in a respective one of said weights.

* * * * *